United States Patent [19]

Crosser

[11] Patent Number: 4,823,974

[45] Date of Patent: Apr. 25, 1989

[54] CHILL CYLINDER FOR BEVERAGE CONTAINERS

[76] Inventor: Hayward B. Crosser, 7015-½ Glasgow Ave., Los Angeles, Calif. 90045

[21] Appl. No.: 110,945

[22] Filed: Oct. 20, 1987

[51] Int. Cl.[4] ..... A45C 11/00

[52] U.S. Cl. ..... 220/85 H; 206/545; 215/12.1

[58] Field of Search ..... 220/85 H, 3.1, 23.83, 220/254; 215/12.1; 206/545

[56] References Cited

U.S. PATENT DOCUMENTS

| | | | |
|---|---|---|---|
| 1,382,070 | 6/1921 | Fate | 215/12.1 |
| 4,228,908 | 10/1980 | Tweeton | 206/545 X |
| 4,351,451 | 9/1982 | Chung | 215/12.1 X |
| 4,444,324 | 4/1984 | Grenell | 206/545 |
| 4,708,254 | 11/1987 | Byrns | 220/85 H X |

*Primary Examiner*—Steven M. Pollard

*Attorney, Agent, or Firm*—Poms, Smith, Lande & Rose

[57] ABSTRACT

A container assembly for chilling wine bottles or the like includes a thermally insulated container, having a preferably cylindrical inner diameter for enclosing the main body of the wine bottle with limited space, such as one-half inch, between the bottle and the inner wall of the container, to receive crushed ice. The cylinder container is sealed around the wine bottle, so that wine may be poured without spilling the ice or melted ice water. The top of the thermally insulated container may be sealed by a ring-shaped member of wedge-shaped cross-section. The thermally insulated container may be sealed at the top or bottom, and may be formed either as a single member or may be formed of two slidable parts to accommodate beverage containers of different sizes.

11 Claims, 4 Drawing Sheets

CHILL CYLINDER FOR BEVERAGE CONTAINERS

FIELD OF THE INVENTION

This invention relates to arrangements for conveniently maintaining containers of beverages, such as wine bottles, for example, in a chilled condition.

BACKGROUND OF THE INVENTION

At the present time, there are two principal ways for chilling beverages, such as wine. First, in many stores where beverages are sold, extended refrigeration cases are provided to maintain a representative stock of wine in a chilled condition. Another arrangement for chilling wine which is commonly used is the ice bucket. Thus, in restaurants, for example, the selected bottle of wine, which is normally not chilled, is brought to the table and placed in an open bucket or container which is filled with ice, to chill the wine.

However, neither of these two types of arrangements are satisfactory for many purposes. Thus, it is expensive to maintain large stocks of wine in refrigerated cases. With regard to the use of ice buckets, they are quite satisfactory under controlled conditions, but are not practical for chilling wine or other beverages while the beverages are being transported in a car or taken to a picnic, for specific examples.

Accordingly, a principal object of the present invention is to provide a simple, effective, and inexpensive technique for chilling beverage containers, such as wine bottles.

SUMMARY OF THE INVENTION

In accordance with the present invention, a container assembly for chilling wine bottles or the like includes a thermally-insulated container, preferably cylindrical in configuration, for enclosing the main body of a wine bottle, with limited space between the bottle and the inside of the container for receiving crushed ice. Arrangements are provided for sealing the cylindrical container both to prevent the leakage of ice and water from the bottom of the container, and also for sealing the upper rim of the container around the neck of the beverage container, so that the beverage such as wine may be poured without spilled the crushed ice or melted ice water, and while continuing to maintain the ice in contact with the outer surface of the beverage container.

The invention has many ramifications, and one or more of the following features may be included in specific illustrative embodiments:

1. The cylindrical main thermally-insulating container may be closed at the bottom, and have a sealing member of wedge-shaped cross-sectional configuration which engages both the top of the cylindrical container and also the neck of the wine bottle, to seal against leakage.

2. A cap or closure member may be provided which fits over the top of the bottle to protect the contents after the bottle has been opened.

3. The wedge-shaped sealing member as mentioned in paragraph 1 hereinabove, may either make a direct wedge-type resilient engagement with both the thermally insulated cylindrical container, and also the wine bottle, or it may make threaded engagement with the top of the container, and with the cap mentioned in paragraph 2 hereinabove.

4. The cylindrical container may be tapered to make a resilient, tight fit with the wine bottle at the neck of the wine bottle, so that crushed ice may be supplied to the space between the wall of the wine bottle and the container, after turning the two members upside down, and then a sealing closure may be secured to close the bottom of the cylindrical container, either with a force-fit, a snap-fit, or threaded engagement.

5. The cylindrical, thermally-insulated container may be formed of foamed plastic, such as "Styrofoam", or may be a two-part member with an outer thin-walled container of metal or plastic, and a liner of thermally-insulated material which could be foamed plastic.

6. If desired, the enclosing container may be partially transparent, so that the label on the wine bottle would be visible.

7. To accommodate bottles of different height, the cylindrical insulating container may be formed of two slidable parts, with one telescoping inside of the other.

8. A thermally-insulated, cylindrical container closed at the bottom may have crushed ice placed in the space between the bottle and the container, and then a flexible sack or plastic bag, which is preferably of a decorative color or pattern, and may be either thermally insulating or non-insulating, depending on the nature of the inner container, and may be tied by a fancy bow around the neck of the bottle to seal the crushed ice and ice water from spillage when the wine is being poured.

9. The invention is also applicable to multiple beverage container usage, with one arrangement involving an insulated block of foamed plastic material with a plurality of cylindrical cavities therein for receiving small bottles or cans of beer, wine, or soft drinks, with space around each container for receiving crushed ice. Further, an insulated cover may extend over the top of the foamed block of insulation.

In general, it is noted that wine bottles are about three inches in diameter, and about a foot or a little less in height, to the neck of the bottle. Accordingly, the insulated container is preferably approximately one foot or slightly less in length, and will have a sufficiently large diameter so that a space of approximately one-half inch will be present between the bottle and the inner wall of the thermally-insulated container. The container will then be approximately four inches in diameter. Of course, smaller containers will be employed for smaller bottles, such as splits of wine, or individual bottles of beer; and substantially larger containers would be employed for one-half gallons of wine, or the like.

Other objects, features, and advantages will become apparent from a consideration of the following detailed description and from the accompanying drawings.

BRIEF DESCRIPTION OF THE DRAWINGS

FIG. 5 illustrates another alternative embodiment of the invention in which the chill container includes an outer thin walled container, and an inner liner of thermally-insulating material, such as foamed plastic or the like.

FIG. 12 is another embodiment of the invention involving the use of a sealing member including two beads or 0-rings of rubber interconnected by a thin wall of rubber of the type found in a balloon or the like;

DETAILED DESCRIPTION

Figure 1:
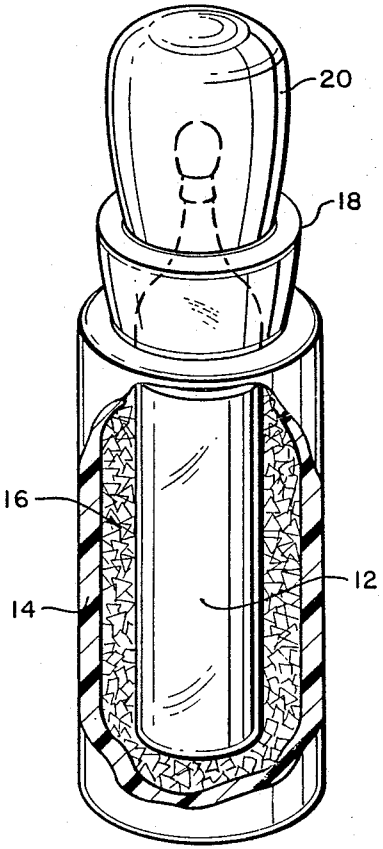
FIG. 1 shows a chill cylinder assembly for wine bottles or the like, illustrating the principles of the present invention.

Referring more particularly to the drawings, FIG. 1 shows a chill cylinder assembly for cooling the wine bottle 12. More specifically, the chill cylinder assembly includes the outer cylindrical container 14 made of thermally-insulating material, such as a foamed plastic. One well-known example of a foamed plastic is "Styrofoam" and that material could be employed. In practice, the wine bottle 12 is set into the thermally-insulating cylinder 14, and the space between the bottle and the inner surface of the container 14 is filled with crushed ice 16. The resilient wedge-shaped sealing member 18 is then jammed into the space between the neck or the upper portion of the wine bottle 12, and the top of the container 14. The sealing member 18 may be made of resilient foam rubber or plastic, or other suitable resilient sealing material. Also provided is a cap closure member 20, which engages the inner surface of the wedge-shaped sealing member 18, to close the top of the bottle after it has been uncorked.

After the bottle has been chilled and uncorked, wine may be poured from the assembly by removing the cap closure member 20 and pouring from the bottle while the thermally-insulated container 14 and the sealing member 18 remain in place to avoid spilling any of the crushed ice 16, or any water formed from the melting of the ice. Accordingly, with the arrangement of FIG. 1, the chilling process continues, even as the wine is being poured. In addition, of course, there is a significant advantage in that the customer at a store where the wine is being purchased may have the bottle immediately packaged as indicated in FIG. 1, so that the chilling process starts at once, and continues while the wine is being taken home or to other locations where it is to be used.

Figure 2:
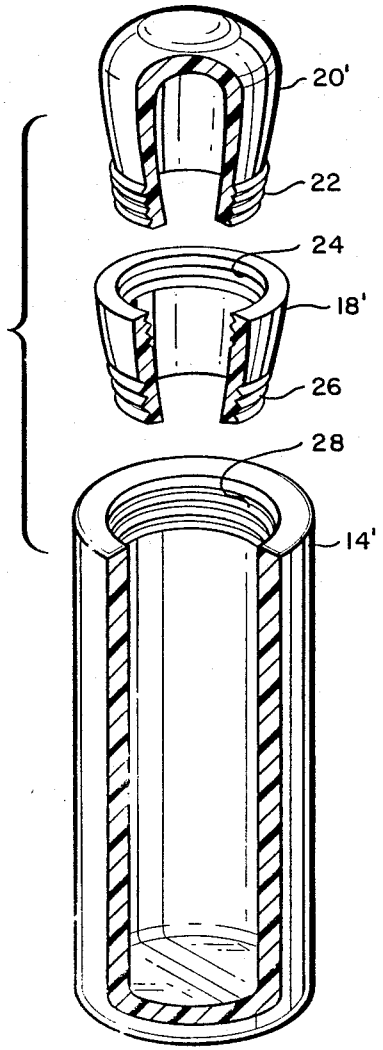
FIG. 2 is a partial showing of a slightly modified version of the assembly of FIG. 1.

FIG. 2 is a partial exploded view showing a minor variation in the arrangement of FIG. 1. More specifically, the cap 20' has exterior threads 22 which engage corresponding interior threads 24 on the sealing member 18'. In turn, the sealing member 18, has exterior threads 26 which engage interior threads 28 on the chill cylinder 14', as shown in the partially cut away view of FIG. 2.

Figure 3:
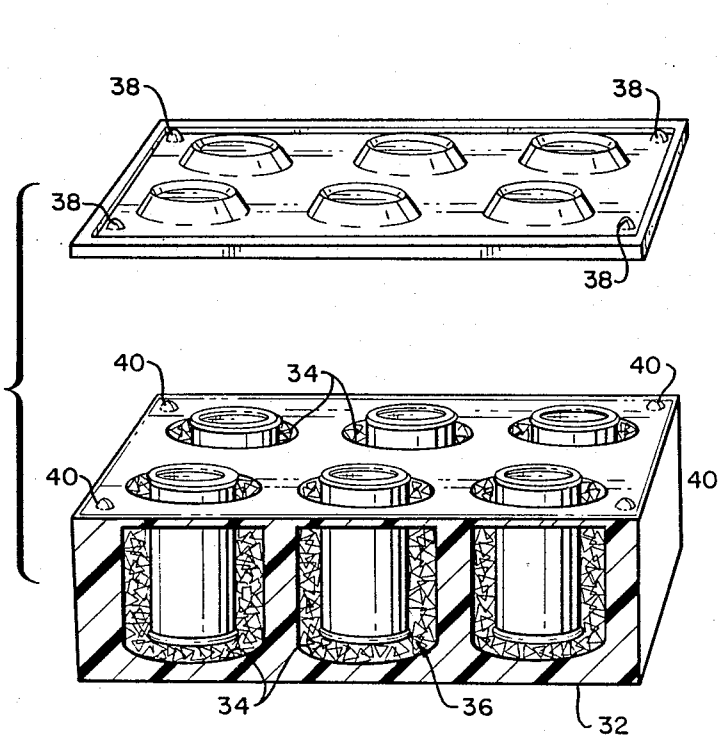
FIG. 3 illustrates the principles of the present invention as applied to a multiple beverage container assembly.

FIG. 3 shows a block 32 of foamed plastic material such as Styrofoam including six recesses 34 into which cans or small bottles of beverages may be placed. Crushed ice 36 may then be placed around each of the beverage containers, and the top 38 employed to cover the unit. The foamed plastic top may have protrusions 38 which interfit with corresponding recesses 40 in the upper corners of the base 32.

Figure 4:
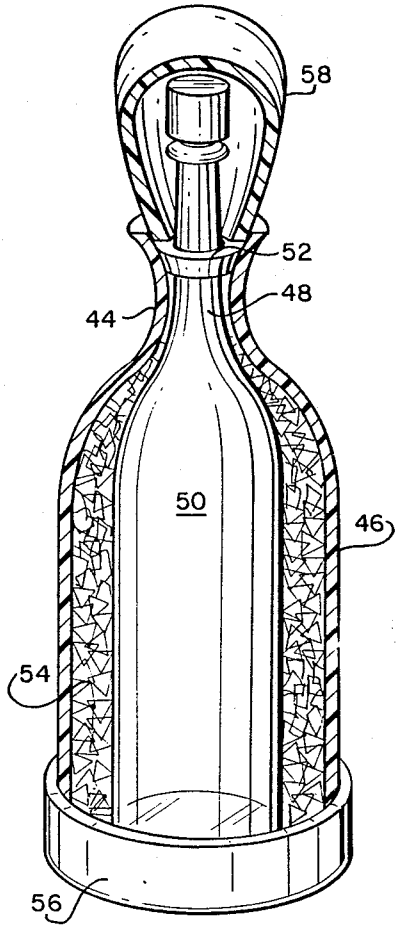
FIG. 4 illustrates an embodiment of the invention in which the chill container is sealed at the bottom.

FIG. 4 shows an alternative embodiment of the invention in which the upper zone 44 of the thermally-insulating chill cylinder 46 is tapered inwardly to facilitate sealing engagement with the neck 48 of the wine bottle 50. The sealing of the inwardly-tapered upper portion 44 of the chill cylinder 46 may be accomplished by direct engagement with the neck 48 of the bottle, or it may be facilitated by the presence of an additional resilient tapered ring member 52 which fits around the neck of the bottle. Following sealing of the upper end of the chill cylinder 46 to the neck of the bottle, the entire assembly is inverted, and crushed ice 54 is located between the bottle and the thermally-insulated chill cylinder, while the assembly is upside down. A lower closure member 56 is then applied to the bottom of the chill cylinder 46. It makes tight sealing engagement, either by screw-threading it onto the member 46, or by a tight frictional engagement or snap-fit. The cap member 58 serves to seal the top of the bottle, after it has been uncorked.

Figure 5:
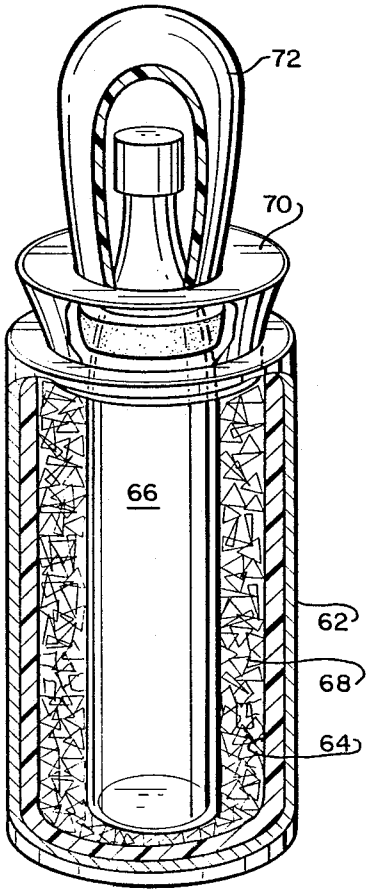

FIG. 5 shows a slightly modified version of the invention in which a thin, outer shell of plastic or metal 62 has an inner, thermally-insulating liner or layer 64. Between the bottle 66 and the thermally-insulating material 64 is the crushed ice 68. To seal between the upper end of the containers 62, 64, and the wine bottle, a sealing member 70 is provided which may wedge into the top of the cylinders 62, 64, and make wedging, sealing engagement with the bottle 66. As in the case of prior embodiments, the cap closure member 72 serves to close the mouth of the bottle, after it has been uncorked.

Figure 6:
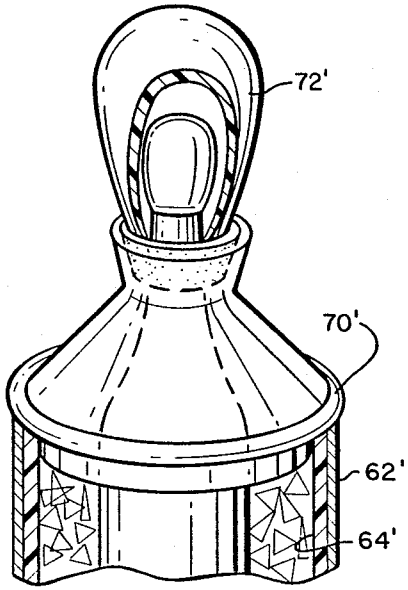
FIG. 6 shows a slightly modified version of the assembly of FIG. 5.

The partial view of FIG. 6 of the drawings is similar to that of FIG. 5, but the sealing member 70' as shown in FIG. 6, makes a locking fit with the upper lip of the chill cylinder 62', 64'. Again, the cap member 72' engages the upper end of the sealing member 70' to protect the contents of the bottle following uncorking.

Figure 7:
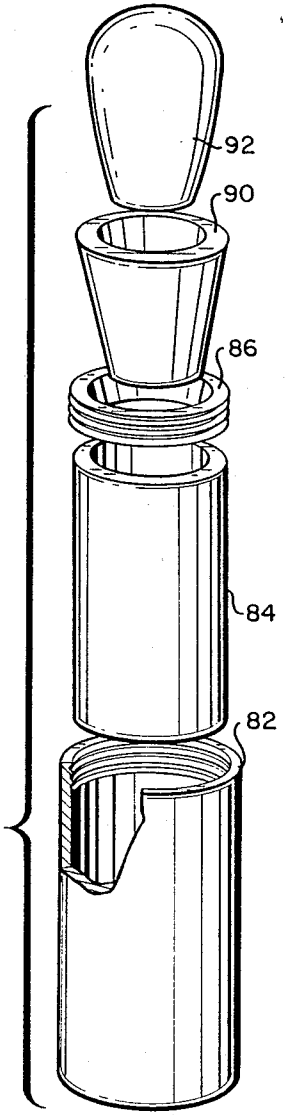
FIG. 7 is an exploded view of a five-part assembly which is similar in many respects to the embodiments of FIGS. 5 and 6.

FIG. 7 is an exploded view of an arrangement wherein a thin walled plastic or metal chill cylinder 82 has a thermally-insulated liner 84 engaging its inner surface, and the cylindrical member 86 is provided with external threads which engage corresponding inner threads at the upper edge of the chill cylinder 82 to lock the thermally-insulating cylinder 84 in position. As in certain of the prior embodiments, the wedge sealer member 90 serves to seal both against the wine bottle (not shown) and the cylindrical member 86, to prevent the spillage of ice or melted ice water when wine is being poured. The cap 92 fits over the top of the wine bottle to protect its contents following uncorking.

Figure 8:
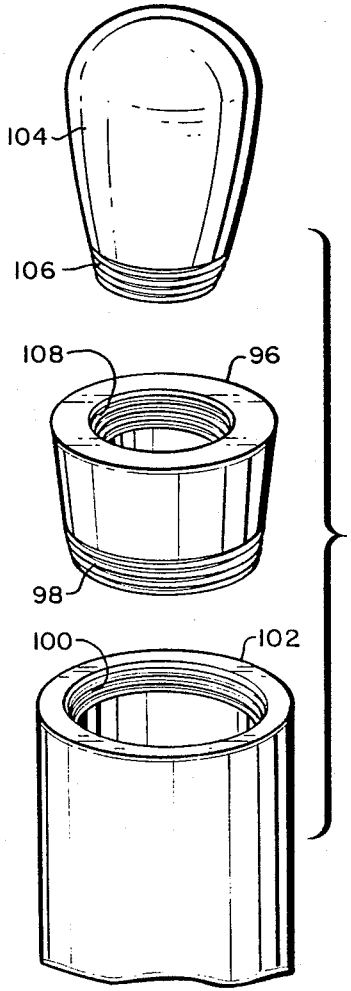
FIG. 8 illustrates an embodiment of the invention in which the insulating cylindrical member, the sealing member, and the cap are threaded together.

FIG. 8 shows a slightly modified version of the invention in which the sealing member 96 has exterior threads 98, which engage corresponding inner threads 100 on the thermally-insulating chill cylinder 102, and concurrently, the sealing member 96 engages and seals against the upper portion or neck of the wine bottle. The cap 104 may be provided with exterior threads 106 which thread into the corresponding interior threads 108 at the top of the sealing member 96.

Figure 9:
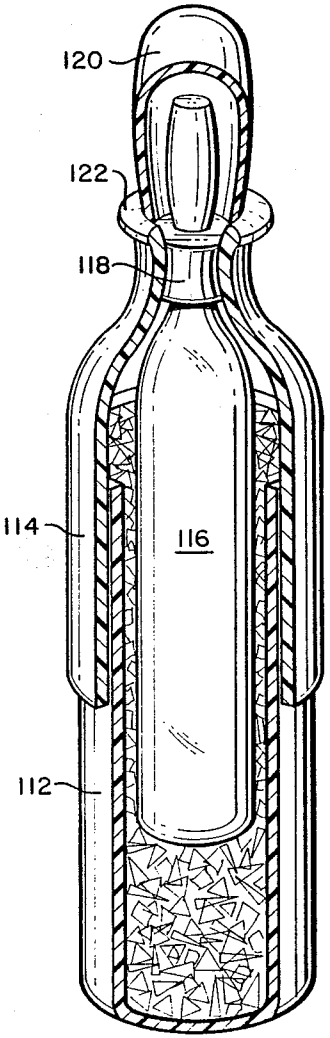
FIG. 9 illustrates an embodiment of the invention in which the cylindrical containers may be varied in length by sliding an upper portion thereof relative to a lower portion of the container.

FIG. 9 illustrates a further alternative embodiment of the invention for accommodating beverage bottles of different shapes, for example, elongated wine bottles. More specifically, the chill cylinder of FIG. 9 includes the lower, cylindrical, thermally-insulating member 112, and the upper portion 114 which slides over the lower member 12, to fully encompass the wine bottle 116. Thus, in practice, the wine bottle is initially set into the lower member 112, and crushed ice is filled into the space between the wine bottle 116 and the lower cylindrical enclosure 112, formed of course of thermally-insulating material. Then, the upper portion 114 of the chill cylinder is slid over the outer surface of the member 112, to make sealing engagement with the neck of the bottle 116. If desirable or necessary, a resilient wedging ring member 118 may be provided, either as a separate member which is applied over the neck of the bottle, or as an insert secured to the upper necked-down portion of the member 114. A cap 120 may be employed to engage the flaired upper end 122 of cylindrical member 114, to seal the assembly after the bottle of wine has been uncorked.

Figure 10:
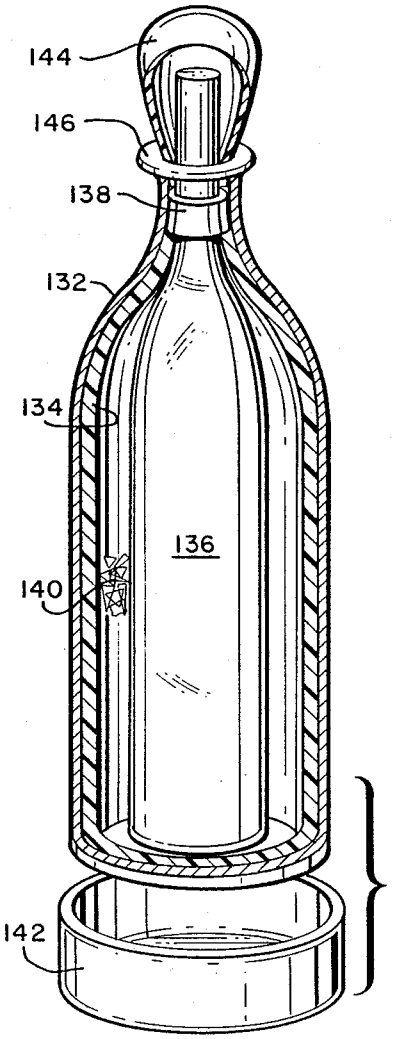
FIG. 10 illustrates an embodiment of the invention with a sealing bottom closure member.

FIG. 10 shows a further embodiment of the invention in which the chill cylinder is formed of an outer thin member 132, and an inner insulating layer or liner 134. The outer cylindrical member 132 may be of metal or hard surfaced plastic, and the liner 134 may be foamed plastic. The wine bottle 136 is inserted into the chill cylinder 132, 134, and makes sealing engagement therewith at the area 138. The entire assembly is then turned upside down, and crushed ice 140 is filled into the space between the bottle and the thermally-insulated layer or liner 134. A sealing bottom member 142 is then secured to the bottom of the units to seal against the leakage of ice or ice water. The bottom 142 may be threaded onto the exterior of the member 132, or make a press, sealing fit therewith. As in the case of prior embodiments of the invention, a cap member 144 may be provided to engage the flaired upper end 146 of the chill cylinder, to protect the contents of the bottle following uncorking.

Figure 11:
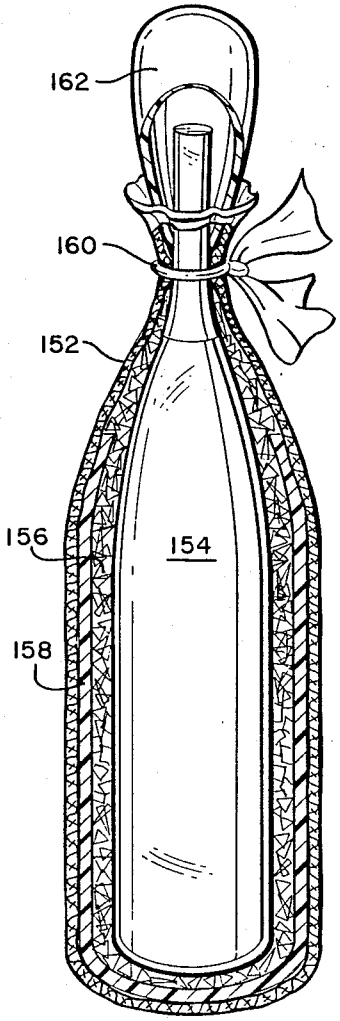
FIG. 11 illustrates a chill cylinder assembly in which an outer flexible bag or sack is employed.

FIG. 11 shows a further embodiment of the invention in which a flexible sack 152 is employed. Between the sack 152 and the wine bottle 154 is the crushed ice 156. Appropriate fully-insulating material is provided, either through the use of a supplemental chill cylinder liner 158 or by forming the sack itself of thermally insulating material through the use of several layers, or the like. The sack 152 is tied firmly and tightly around the neck of the bottle by the decorative tie 160. This tie 160 seals the sack around the neck of the bottle, with the help of an additional resilient member, if needed. This prevents spillage of the ice or melted water when wine is being poured from the bottle. The cap 162 may be provided to fit over the top of the bottle and protect its contents following uncorking.

Figure 13:
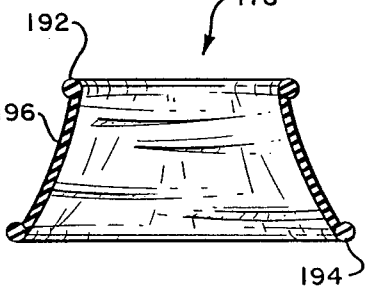
FIG. 13 is a detailed cross-sectional showing of the sealing member employed in FIG. 12.
Figure 12:
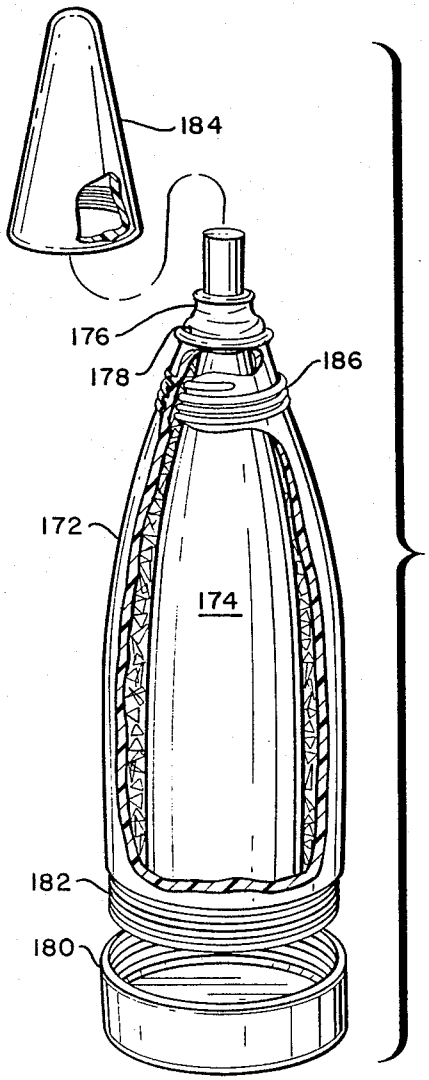

FIG. 12 shows a further embodiment of the invention in which an insulating container 172 may be formed of either a single insulating member, or an outer thin container with an inner insulating liner. A bottle 174 which is to be chilled is mounted within the container 172, and a rubber sealing member 176 of the type shown in detail in FIG. 13 is mounted to seal between the upper end of container 172, which has an out-turned upper lip 178, and the neck of the bottle. After this sealing member 176 is in place, the bottle 174 and the container 172 are turned up-side-down together, and crushed ice is fed into the space between the bottle 174 and the insulating container 172. The bottom 180 has internal threads which mate with the external threads 182 on the outer bottom surface of the container 172 so that the ice is sealed into the space between the bottle 174 and the container 172. The top 184 is provided with internal threads which mate with the external threads 186 on the container 172. Accordingly, with this arrangement, the top 184 may be removed, and wine or other liquid poured from the bottle 174 without danger of spilling ice water from around the upper end of the container 174.

The sealing member 176 as shown in FIGS. 12 and 13, includes an upper bead 192 and a lower bead 194, interconnected by a very thin film of rubber material 196, such as that found in a balloon. Similarly, the beads 192 and 194 are of the general type found at the outer edge of the mouth of a balloon where it is blown up. The sealing members, such as that shown in FIG. 13 may be of varying diameter to suit any desired sealing geometry, as shown for example in FIG. 12 described hereinabove, or in FIGS. 14 and 15, to be described hereinbelow.

Figure 14:
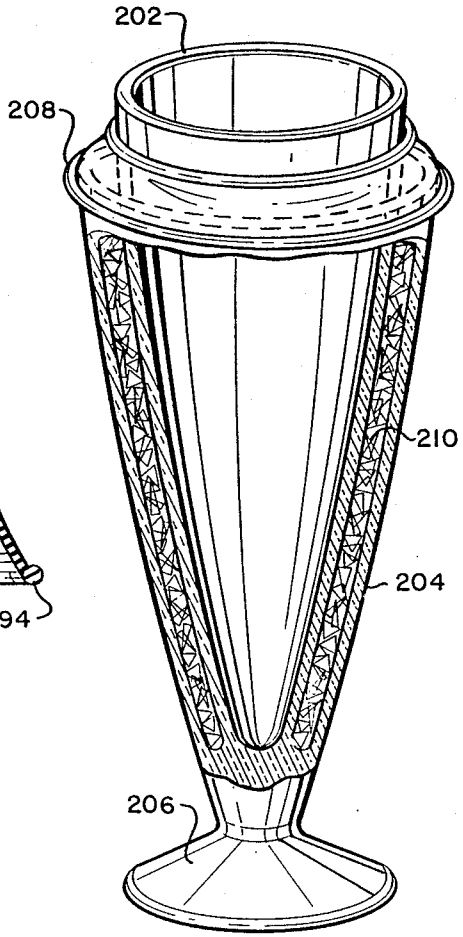
FIG. 14 shows the applicability of a sealing element of the type shown in FIG. 13 to a double wall drink container.

Now, referring to FIG. 14, a double walled glass for beer or the like includes an inner glass portion 202 and an outer portion 204 generally concentric with the inner portion 202, but spaced apart from it, to receive crushed ice or the like in the space between the inner conical member 202 and the outer conical member 204, which are joined at the base 206. A brightly colored rubber sealing member 208, of the type shown in FIG. 13 seals between the inner member 202 and the outer concentric member 204, so that the drink is kept cold, and no spillage occurs when beer or other drinks are imbibed from the assembly. Ice 210 is contained in the space between the two walls.

Figure 15:
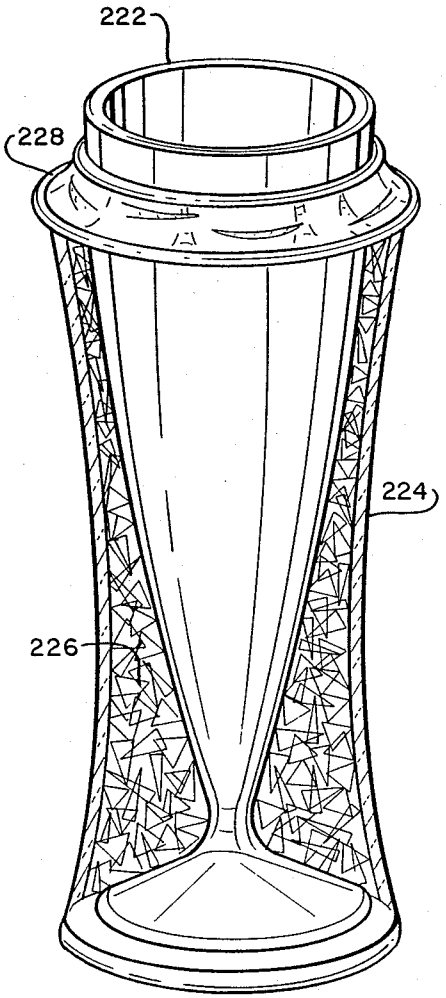
FIG. 15 shows the applicability of a resilient sealing member of the type shown in FIG. 13 to a beer glass enclosed within an open mouth container for holding ice.

The assembly of FIG. 15 is similar to that of FIG. 14, with the exception that the beer glass 222 is a conventional beer glass which is separate from the enclosing open glass member 224 within which ice 226 is maintained to keep the beer or other drink in the glass 222 at the desired chilled temperature. The seal 228 is of the type shown in FIG. 13, with an upper and a lower bead, and a very flexible intermediate film of rubber for sealing between the two beads.

In conclusion, it is to be understood that certain preferred embodiments of the invention have been described hereinabove and have been illustrated in the accompanying drawings. However, various changes and modifications may be made without departing from the spirit and scope of the invention. Thus, by way of example, and not of limitation, where threaded couplings have been disclosed, press fit or snap couplings may be employed, and vice versa. Similarly, although emphasis has been placed on the chilling of bottles of wine, the invention is also applicable to the chilling of other containers for beverages, such as beer, soft drinks, juices, or the like. Also, various known insulating materials other than foamed plastic may be employed. Accordingly, the present invention is not limited to that described in detail hereinabove and illustrated in the drawings.

What is claimed is:

1. A container assembly for chilling wine bottles or the like comprising:

a bottle of a potable liquid;

said bottle having a neck portion;

a thermally insulating container having a closed bottom and an open top, for enclosing the main body of said bottle, with sufficient additional space for a quantity of small particles of ice sufficient to chill the bottle of liquid between the container and the bottle, said space for ice constituting a substantial proportion of the space within the container;

said open top having internal threads;

ice in a finely divided form filling the space between said bottle and said container;

means for sealing around the top of the container between the bottle and the container, whereby the potable liquid may be poured from the bottle without spilling the ice or water from the melted ice;

said means for sealing being wedge shaped and having a central opening for receiving and sealing surrounding said bottle neck portion;

said means for sealing having lower external threads, for sealingly engaging the container internal threads, and upper threads; and cap means for engaging said sealing means for covering the top of the bottle after it has been opened said cap means having lower threads for mating with the upper threads of said wedge shaped sealing means.

2. A container assembly as defined in claim 1 wherein said sealing means includes means for making wedging sealing engagement with the bottle.

3. A container assembly as defined in claim 1 wherein said thermally insulated container is an inexpensive disposable container and is formed at least in part of a waterproof foamed plastic.

4. A container assembly as defined in claim 1 wherein said thermally insulated container includes an outer shell, and an inner liner of foamed plastic material.

5. A container assembly as defined in claim 1 wherein the inner diameter of said insulating container is in the order of four inches, to allow space for finely divided ice to be supplied between the bottle and the container.

6. A container assembly as defined in claim 1 wherein said thermally insulating container is substantially cylindrical in configuration.

7. A container assembly as defined in claim 1 wherein said thermally insulated container is formed in two parts comprising an upper and a lower part with the upper part making a close sliding fit with the lower part, whereby bottle containers of different shapes are readily acommodated.

8. A container assembly as defined in claim 1 wherein there is in the order of one-half inch distance from the outer wall of the bottle to the inner wall of the container defining the space for receiving ice.

9. A container assembly for chilling wine bottles, beer glasses, or the like comprising:

a potable liquid receptacle said, receptacle having a neck portion;

a container for enclosing the main body of said potable liquid receptacle, with space between the receptacle and the inside of the container for receiving finely divided ice, said space for ice constituting a substantial proportion of the space with the container;

said container having an open bottom and an open upper neck portion having an outwardly flared upper end;

ice in finely divided form filling the space between said receptacle and said container in sufficient quantity to chill said potable liquid receptacle;

removable closure means for sealing said container bottom to prevent the leakage of water from said melted ice; and said container assembly including sealing means for resilient closing the space between said container and the upper portion of said receptacle to prevent the spilling of ice or water from said container when liquid is poured or drunk from said receptacle;

said sealing means being wedge shaped and having a central opening for receiving and sealingly surrounding said receptacle neck portion;

a closure member having an inwardly tappered lower end for frictionally engaging the inner surface of the flared neck portion.

10. A container assembly as defined in claim 9 wherein said thermally insulated container is formed in two parts comprising an upper and a lower part with the upper part making a close sliding fit with the lower part, whereby bottle containers of different shapes are readily accommodated.

11. A container assembly as defined in claim 9 wherein said closure means is a ring-shaped member having a wedge-shaped cross-section for sealing the top of the beverage container to the thermally insulated container.

* * * * *